US007246407B2

(12) United States Patent
Park et al.

(10) Patent No.: US 7,246,407 B2
(45) Date of Patent: Jul. 24, 2007

(54) HEIGHT ADJUSTING APPARATUS FOR SUCTION BRUSH OF UPRIGHT VACUUM CLEANER

(75) Inventors: Jung-seon Park, Gwangju (KR); Byung-jo Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 624 days.

(21) Appl. No.: 10/667,838

(22) Filed: Sep. 22, 2003

(65) Prior Publication Data

US 2004/0211027 A1 Oct. 28, 2004

(30) Foreign Application Priority Data

Apr. 22, 2003 (KR) ..... 10-2003-0025437
Jun. 5, 2003 (KR) ..... 10-2003-0036236

(51) Int. Cl.
*A47L 5/34* (2006.01)

(52) U.S. Cl. ..... 15/354; 15/368

(58) Field of Classification Search ..... 15/354, 15/368

See application file for complete search history.

(56) References Cited

U.S. PATENT DOCUMENTS 3,683,448 A * 8/1972 Lagerstrom et al. ..... 15/354
4,446,594 A 5/1984 Watanabe et al.
5,970,576 A * 10/1999 Maurer et al. ..... 15/354
5,974,625 A 11/1999 Garner
6,081,963 A * 7/2000 Jailor et al. ..... 15/368
6,357,076 B1 * 3/2002 Lee ..... 15/354
6,363,573 B1 4/2002 Harsh

FOREIGN PATENT DOCUMENTS

JP 62207419 9/1987
KR 1986-0001635 10/1986
KR 2001-0012060 2/2001

* cited by examiner

*Primary Examiner*—Gladys J P Corcoran
*Assistant Examiner*—Laura C Guidotti
(74) *Attorney, Agent, or Firm*—Ladas & Parry LLP

(57) ABSTRACT

Disclosed is a height adjusting apparatus for a suction brush of an upright vacuum cleaner, by which a user can facilely adjust a gap between the suction brush and a cleaning surface. The apparatus comprises a suction brush body; a height adjusting knob rotatably disposed at a seating portion formed in the suction brush body, and having a cam curve portion formed at a part of an end of the height adjusting knob inserted into the suction brush body, the cam curve portion having a height difference between a starting point and an end point thereof and a plurality of recessed grooves formed between the starting point and the end point; a height adjusting shaft integrally formed with a rod member which is contacted with the cam curve portion and lifted up and down according to a rotational direction of the height adjusting knob; and a brush front wheel rotatably coupled to the height adjusting shaft.

7 Claims, 9 Drawing Sheets

HEIGHT ADJUSTING APPARATUS FOR SUCTION BRUSH OF UPRIGHT VACUUM CLEANER

BACKGROUND OF THE INVENTION

1. Field of the Invention

The present invention relates to an upright vacuum cleaner, and more particularly, to a height adjusting apparatus for a suction brush of an upright vacuum cleaner, by which a user can facilely adjust a gap between the suction brush and a surface (hereinafter, called 'cleaning surface) of an object to be cleaned.

2. Description of the Related Art

Generally, an upright vacuum cleaner includes a main body having a driving motor for generating a suction force, and a suction brush disposed at a lower side of the main body to be rotated at a desired angle.

In the main body, there are provided a filtering means and a dust collecting container, etc. Foreign substance sucked through the suction brush by the suction force of the driving motor is filtered by the filtering means and then collected in the dust collecting container.

Furthermore, on an upper portion of the main body, there is provided a handle with an on/off switch. Therefore, a user grasps the handle and moves the vacuum cleaner along a cleaning surface. Then, the dust or foreign substance on the surface of the object to be cleaned is sucked through the suction brush.

In this upright vacuum cleaner, there is provided a height adjusting apparatus for adjusting a height between the suction brush and the cleaning surface. Such height adjusting apparatus is classified into various types such as a lever type, a knob type, etc.

The lever type is operated by a user's foot, as described in Korean Patent Laid-Open Publication No. 2001-0012060. Since the lever type is operated by the user's foot, it is easy to adjust the height. However, its components may be complicated, and the apparatus may be also damaged by excessive force due to the using of foot.

The knob type is described in Korean Patent No 1986-001635 as an example. In this knob type, the user rotates a knob with his/her hand to lift up and down a shaft supporting a front wheel of the vacuum cleaner and thus adjust the height of the suction brush. It is easy to use, but there is a problem that, since the height of the suction brush is easily changed by an external impact, it is difficult to expect the apparatus to be stably operated. In other words, there is provided a stepped portion at a bottom surface of the knob so as to lift up and down the shaft. Since an elastic member for supporting the shaft tends to easily lose its supporting force by the external impact, when the suction brush is bumped against a wall or an obstacle during a cleaning operation, the knob is optionally rotated, so that the height adjusted by the user is changed. Therefore, there is an inconvenience that the user has to adjust the height of the suction brush again.

SUMMARY OF THE INVENTION

Therefore, it is an object of the present invention to provide to a height adjusting apparatus for a suction brush of an upright vacuum cleaner with an improved structure by which a user can adjust a height between a suction brush and a cleaning surface with a small force.

It is another object of the present invention to provide a height adjusting apparatus for a suction brush of an upright vacuum cleaner, which is capable of adjusting the height of the suction brush step by step and in accordance with the status of the surface to be cleaned.

To achieve one object of the present invention, there is provided a height adjusting apparatus for a suction brush of an upright vacuum cleaner, comprising a suction brush body; a height adjusting knob rotatably disposed at a seating portion formed in the suction brush body, and having a cam curve portion formed at a part of an end of the height adjusting knob inserted into the suction brush body, the cam curve portion having a height difference between a starting point and an end point thereof and a plurality of recessed grooves formed between the starting point and the end point; a height adjusting shaft integrally formed with a rod member which is contacted with the cam curve portion and lifted up and down according to a rotational direction of the height adjusting knob; and a brush front wheel rotatably coupled to the height adjusting shaft.

According to the present invention, the suction brush body comprises a brush frame which has a suction portion for sucking dust at a lower surface thereof and in which the height adjusting shaft is disposed; and a brush cover for sealing an upper surface of the brush frame except for the suction port.

The seating portion comprises a seating member disposed at the brush frame and a seating hole formed through the brush cover.

Further, the seating member is partially cut away to form a space portion for allowing the seating member to be elastically deformed.

Preferably, the height adjusting knob comprises a cylindrical knob body, a handle portion formed at an upper surface of the knob body to rotate the height adjusting knob, a flange portion protruded along an outer circumferential surface of the knob body to decide an inserting position of the knob body, a fixing protrusion seated in a fixing groove formed at an inner surface of the seating member to procedurally control a rotation of the handle, and a cam curve portion rounded so that the recessed grooves are softly connected to each other.

Furthermore, the fixing protrusion is protruded at a lower surface of the flange portion, and a surface of the fixing protrusion contacted with the fixing groove is rounded.

Preferably, the fixing groove can be provided in plural number in a length direction of the seating member at regular intervals with each other, and each fixing groove has a shape corresponding to the fixing protrusion.

Further, the fixing grooves may be formed corresponding in number to the recessed grooves of the cam curve portion.

The height adjusting knob is rotatably coupled to a shaft receiving groove formed a bottom surface of the brush frame.

The height adjusting shaft may include a shaft body connected at both ends with a brush front wheel, a rotary shaft connected at both ends to the shaft body, secured to the shaft receiving groove by a screw to rotate the height adjusting shaft, and a reinforcing rib disposed between the shaft body and the rotary shaft to prevent the shaft body from twisting.

The shaft receiving groove is communicated with the front wheel receiving hole formed in the brush frame so that the front wheel is not interfered with the brush frame.

The height adjusting shaft is made of an aluminum.

BRIEF DESCRIPTION OF THE DRAWINGS

The above objects and other advantages of the present invention will become more apparent by describing in detail the preferred embodiments thereof with reference to the attached drawings in which.

DETAILED DESCRIPTION OF THE PREFERRED EMBODIMENTS

Now, a height adjusting apparatus for a suction brush of an upright vacuum cleaner according to a preferred embodiment of the present invention will be described in detail with reference to the annexed drawings.

Figure 1:
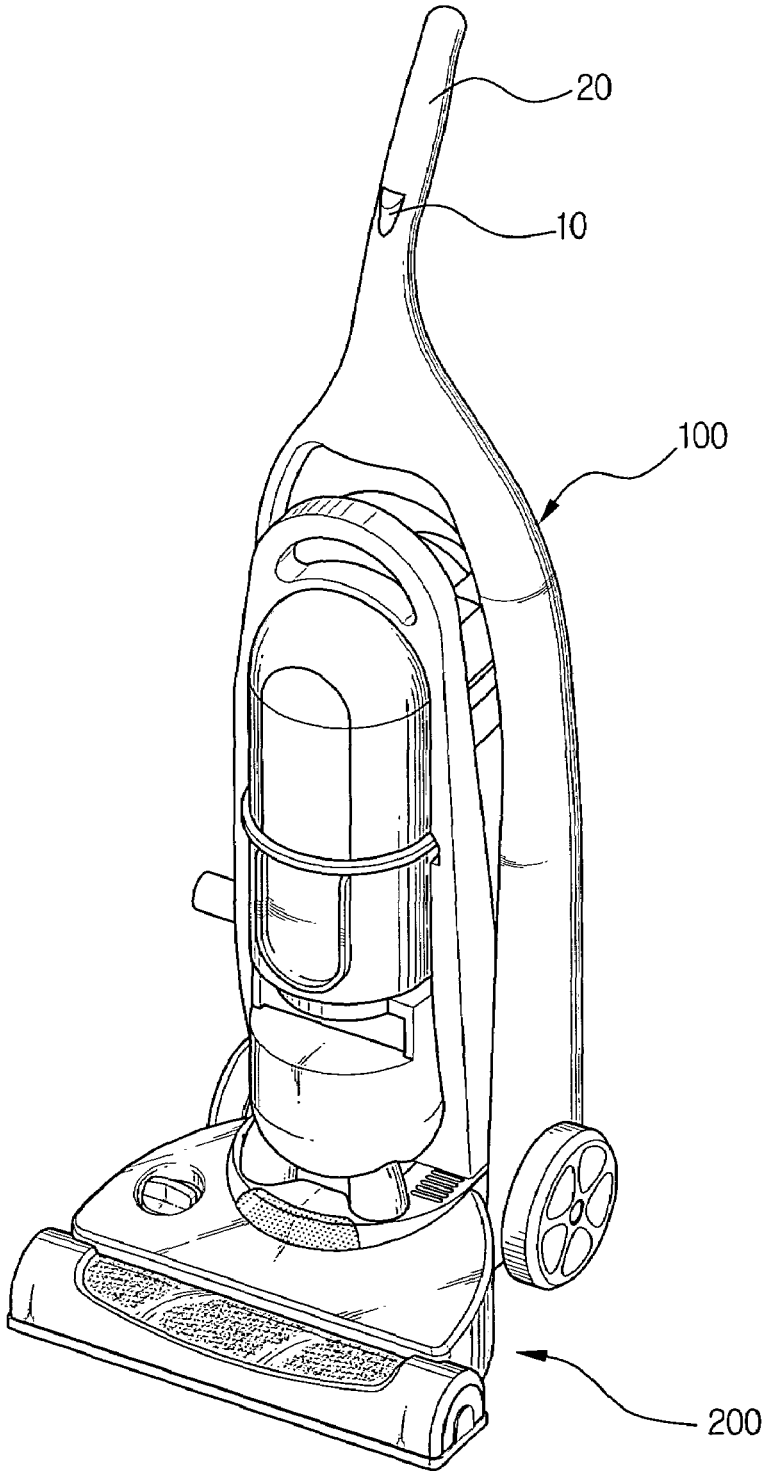
FIG. 1 is a perspective view of a shape of an upright vacuum.

FIG. 1 is a perspective view of a general upright vacuum cleaner.

As shown in FIG. 1, an upright vacuum cleaner generally comprises a main body 100 having a driving motor (not shown) for generating a suction force, and a suction brush 200 disposed at a lower side of the main body to be rotated at a desired angle.

The main body 100 is provided with a filtering means and a dust collecting container, etc. Foreign substance sucked through the suction brush 200 by the suction force of the driving motor is filtered by the filtering means and then collected in the dust collecting container.

Further, at an upper side of the main body 100, there is provided a handle 20 having an on/off switch 10. Therefore, when performing a cleaning operation, a user moves the vacuum cleaner, while grasping the handle 20. The foreign substance and dust on a cleaning surface is sucked and removed through the suction brush 200.

Figure 2:
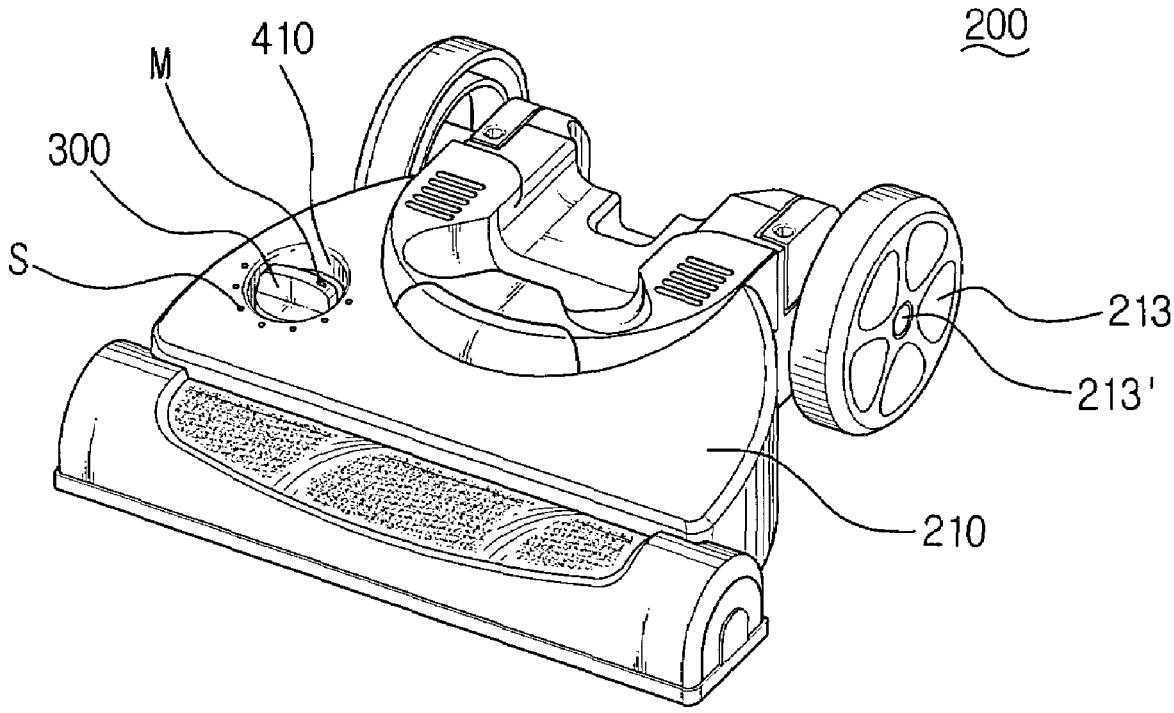
FIG. 2 is a perspective view of a suction brush of the upright vacuum cleaner with a height adjusting apparatus according to the present invention.

As shown in FIGS. 2 to 4, the suction brush 200 comprises a suction brush body 210, a height adjusting knob 300, a seating portion 400 and a height adjusting shaft 500.

The suction brush body 210 includes a brush frame 211 and a brush cover 212 for sealing an upper surface of the brush frame 211. A brush wheel 213 is disposed at both sides of the brush frame 211 by the wheel shaft 213', and a suction port 220 for sucking the dust is provided at a bottom surface. In the suction port 220, there is provided a rotating brush 221 for flying away the dust on the cleaning surface to help the cleaning operation.

Figure 5:
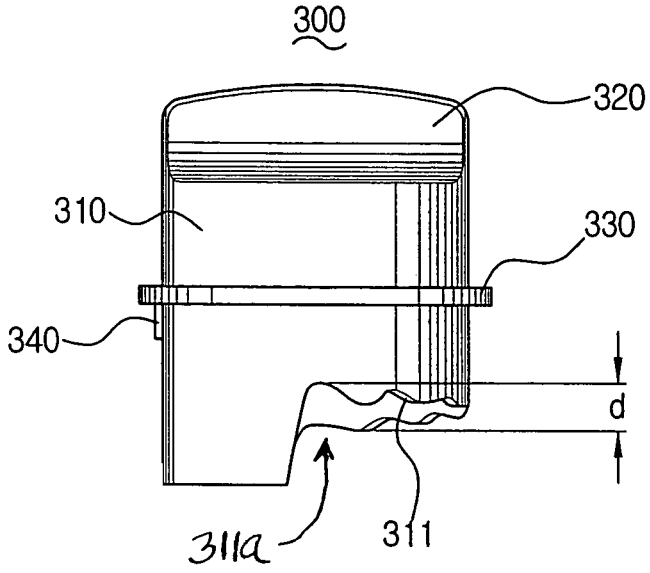
FIG. 5 is a front view of a height adjusting knob of FIG. 2.
Figure 6:
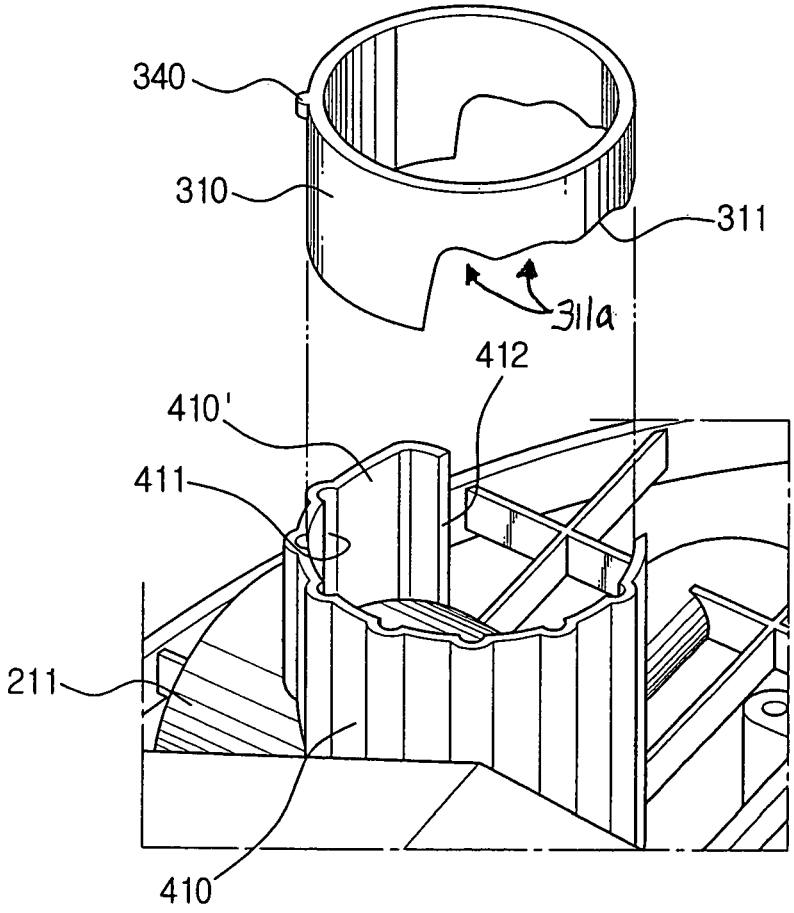
FIG. 6 is an exploded partial perspective view showing a method of assembling the height adjusting knob of FIG. 2.

As shown in FIGS. 5 and 6, the height adjusting knob 300 is rotatably mounted in the seating portion 400 formed at the suction brush body 210. A cam curve portion 311 is partially formed at an end of the height adjusting knob 300, which is inserted into the suction brush body 210. In other words, the height adjusting knob 300 includes a cylindrical knob body 310, an handle portion 320 formed at an upper portion of the knob body 310 so that the user can rotate the height adjusting knob 300, a flange portion 330 protruded along an outer circumferential surface of the knob body 310 so as to determine an inserting portion of the knob body 310, and a fixing protrusion 340 disposed in a fixing groove 411 formed at an inner surface of the seating portion 400 so as to procedurally control a rotation of the handle portion 320.

The knob body 310 is formed with the handle portion 320 at an upper side thereof which is located above the flange portion 330, and the cam curve portion 311 at a lower side thereof which is located below the flange portion 330. Further, the fixing protrusion 340 is formed at the lower surface of the flange portion 330. At this time, a portion of the fixing protrusion 340, which is contacted with the fixing groove 411, is rounded so that the user can facilely rotate the height adjusting knob 300 with small force.

Figure 7:
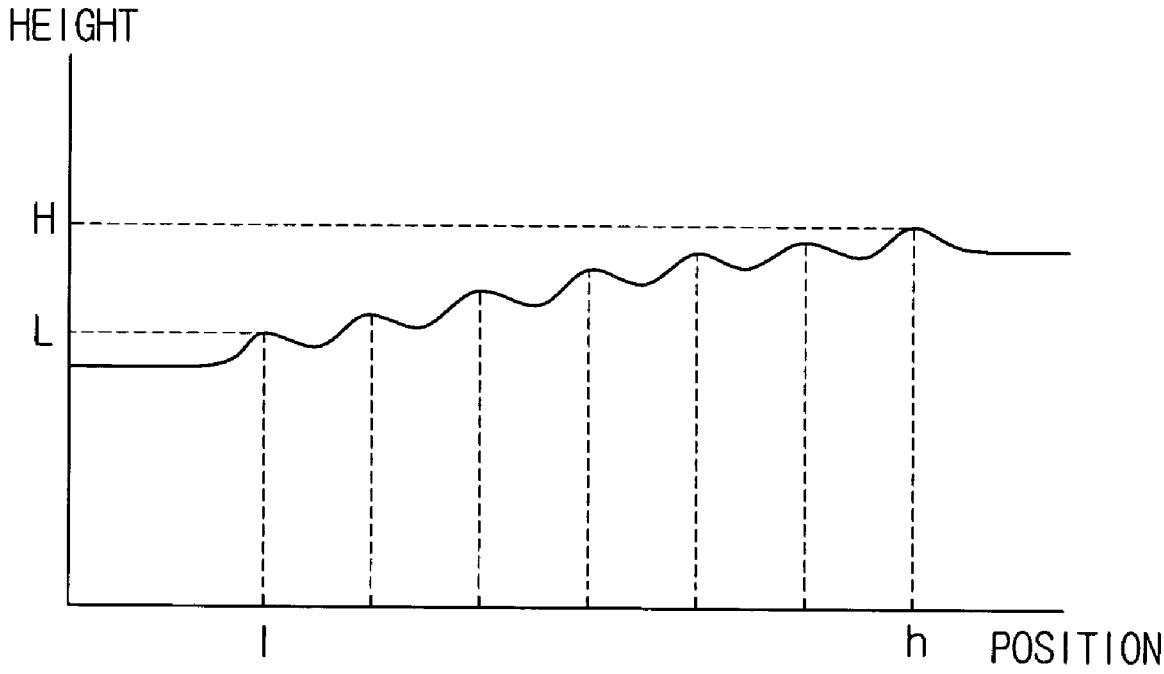
FIG. 7 is a graph showing a trace of a cam curve portion of the height adjusting knob of FIG. 2.

Meanwhile, the cam curve portion 311 is formed to lift up and down the height adjusting shaft 500, as described below, when the user rotates the height adjusting knob 300. The cam curve portion 311 has a desired height difference d between a starting point and an end point thereof, and also has an uneven shape with a plurality of recessed grooves 311*a*. The cam curve portion 311 is partially formed at the seating end of the height adjusting knob 300. Preferably, the cam curve portion 311 is formed at half portion of the entire end thereof. Due to the shape of the cam curve portion 311, the height adjusting knob 300 can be rotated from the start point and the end point at an angle of 180 degrees. Furthermore, as shown in FIG. 7, a trace of the cam curve portion 311 has a first position 1 having a lowest height L between the cleaning surface and the suction brush body 210 and a second position h having a highest height H therebetween. A function of the uneven cam curve portion 311 will be described later together with the height adjusting shaft 500.

The handle portion 320 has a vertically protruded shape so that the user can comfortably grasp the handle portion 320. At one side of the handle portion 320, there is formed a mark M for designating the height of the suction brush body 210. The mark M indicates a height state sign marked around a seating hole 420 of the brush cover 312, which is described later, so that the user can visually check the height between the suction brush body 210 and the cleaning surface.

The flange portion 330 is formed to protrude along the outer circumferential surface of the knob body 310 with a desired thickness. The flange portion 330 decides an inserting degree of the height adjusting knob 300. At the lower surface of the height adjusting knob 300, there is provided one or more fixing protrusion 340. According to an embodiment, it is preferred that one fixing protrusion 340 is formed at a center portion of the outer circumferential surface of the height adjusting knob 300 that the cam curve portion 311 is not formed.

The seating portion 400 is formed with a seating member 410 formed at the brush frame 211 and the seating hole 420 formed through the brush cover 212.

The seating member 410 is integrally formed with the brush frame 211. The fixing groove 411 is formed at an inner surface of the seating member 410. Concretely, the multiple fixing grooves 411 are formed from an upper side of the inner surface of the seating member 410 toward a lower side thereof so as to be corresponded to a shape of the fixing protrusion 340. Preferably, the number of the fixing grooves 411 is corresponded to the number of recessed grooves 311*a* of the cam curve portion 311. In other words, if there is provided seven recessed grooves 311 of the cam curve portion 311 are provided, the seven fixing grooves 411 are formed at the inner surface of the seating member 410. The fixing grooves 411 are apart away from each other at regular intervals so as to control the rotation of the height adjusting knob 300. At this time, a distance between the fixing grooves 411 is the same as a distance between the recessed grooves 311*a* of the cam curve portion 311.

In addition, the inner surface of the seating member 410 is partially cut away to form a space portion 412. The space portion 412 is to allow the seating member 410 to be elastically deformed, so that the fixing protrusion 340 can be deviated from the fixing groove 411 upon the rotation of the height adjusting knob 300.

The seating hole 420 is formed through the brush cover 312. Indicating scales S for representing the height of the suction brush body 210 are formed around the seating hole 420. Preferably, the indicating scales S provides seven steps. Each step lifts up and down the suction brush body 210 at a desired distance corresponding to the cam curve portion 311.

Meanwhile, the height adjusting shaft 500 is disposed at the brush frame 211. The height adjusting shaft 500 is integrally formed with a rod member 510 which is contacted with the cam curve portion 311 to be lift up and down according to a rotational direction of the height adjusting knob 300.

Figure 3A:
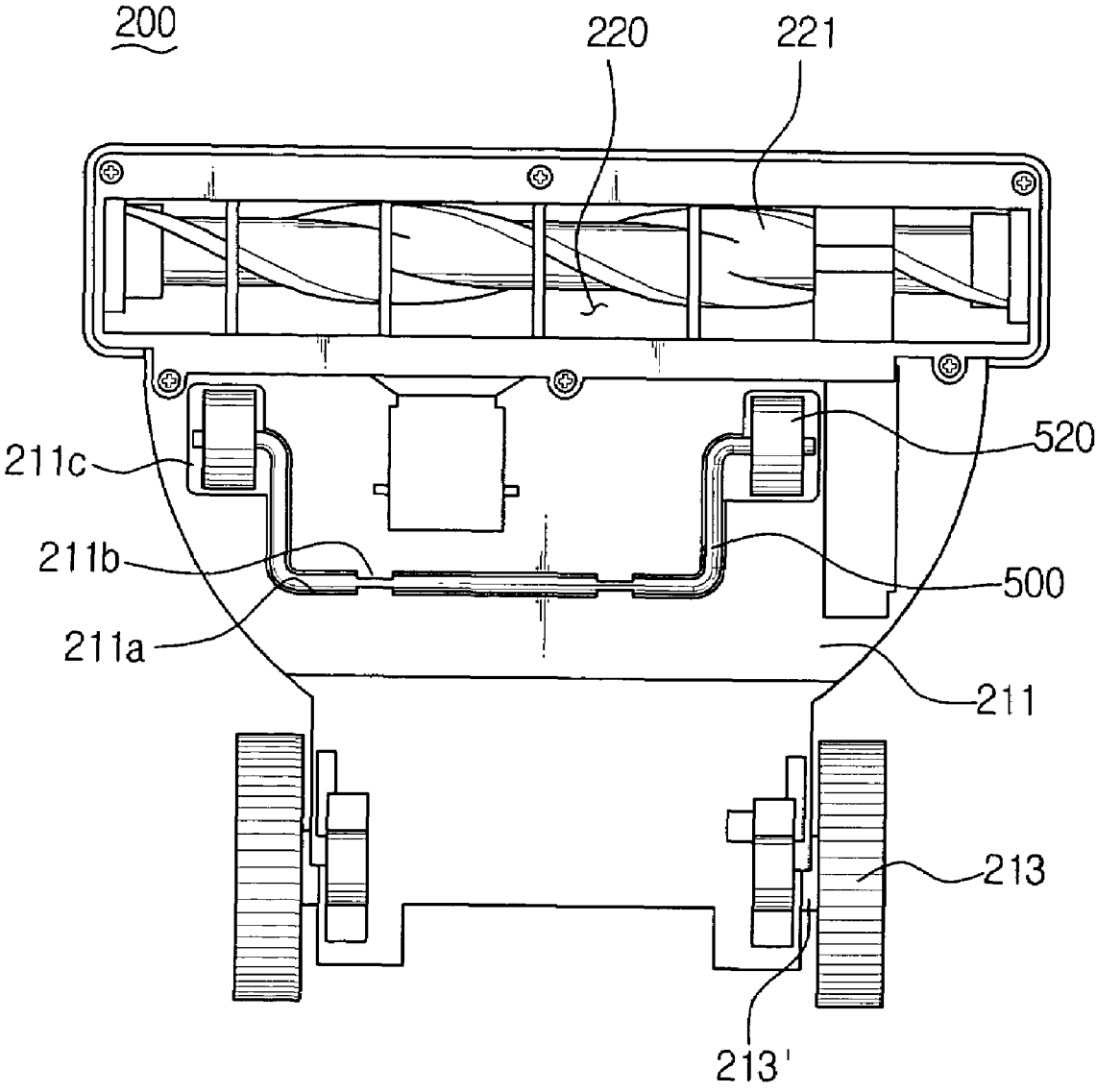
FIG. 3A is a plan view illustrating the lower side of the suction brush of FIG. 2 to show a height adjusting shaft according to a first preferred embodiment of the present invention.
Figure 4A:
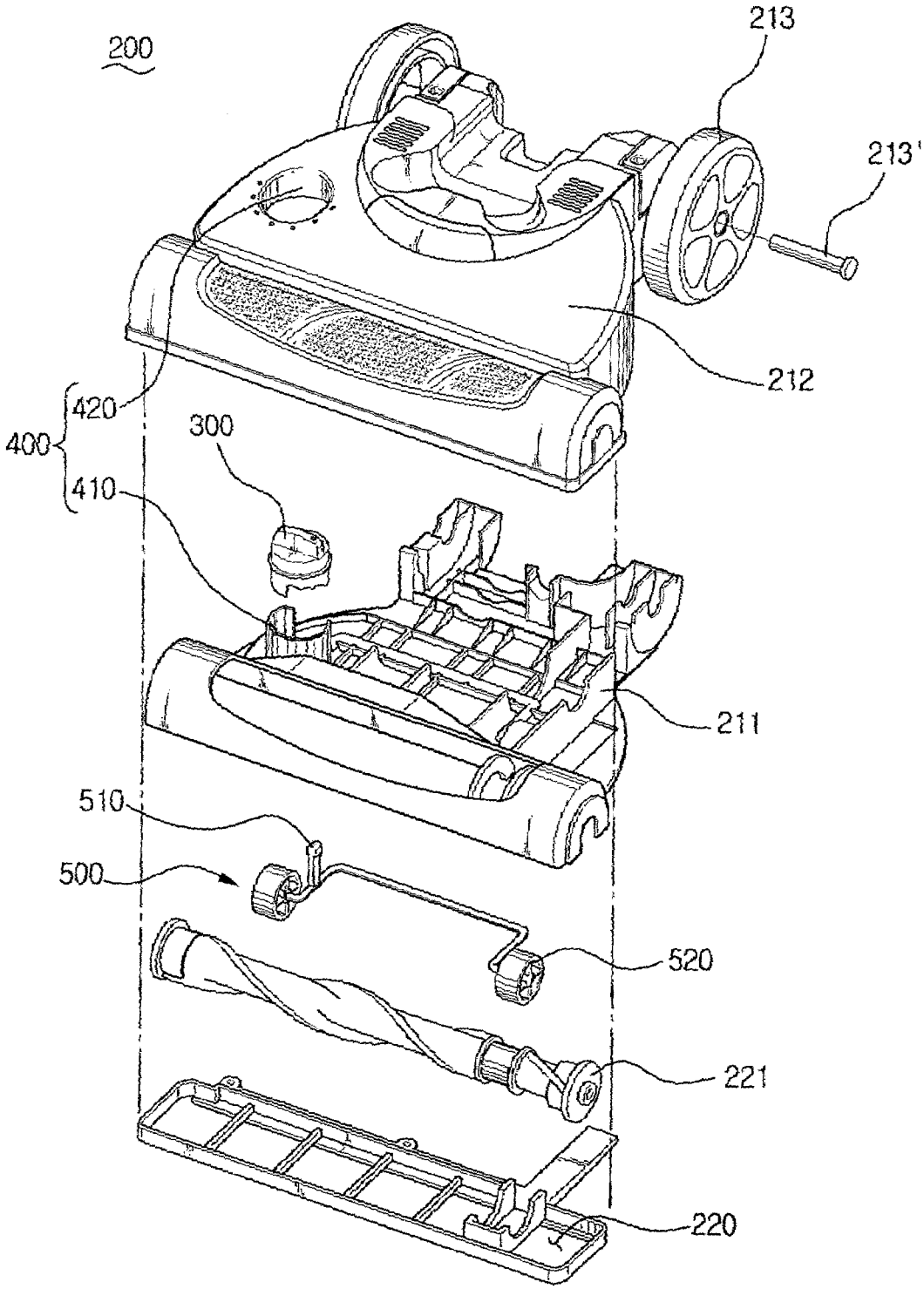
FIG. 4A is an exploded perspective view of a suction brush of a vacuum cleaner having a height adjusting shaft according to a first preferred embodiment of the present invention.

According to the first preferred embodiment of the present invention, as shown in FIGS. 3A and 4A, a brush front wheel 520 is rotatably coupled to both bent ends of the height adjusting shaft 500. Therefore, when the height adjusting knob 300 is rotated, the height adjusting shaft 500 is lifted up and down according to the rotation of the height adjusting knob 300. And when the height adjusting shaft 500 is lifted up and down, a position of the brush front wheel 520 contacted with the cleaning surface is also lifted up and down, and thus the suction brush body 210 is spaced apart from the cleaning surface.

The height adjusting shaft 500 is disposed in a shaft receiving groove 211*a* at which is formed in the bottom of the brush frame 211, and prevented from separating due to a plurality of latching protrusions 211*b* formed on the shaft receiving groove 211*a*. Further, the shaft receiving groove 211*a* is communicated with a front wheel receiving hole 211*c* formed through the brush frame 211 so that the front wheel 520 is not interfered with the brush frame 211. Therefore, since the rod member 510 is integrally formed with the height adjusting shaft 500 near the front wheel receiving hole 211*c*, the rod member 510 can be contacted with the cam curve portion 311 of the height adjusting knob 300.

Figure 3B:
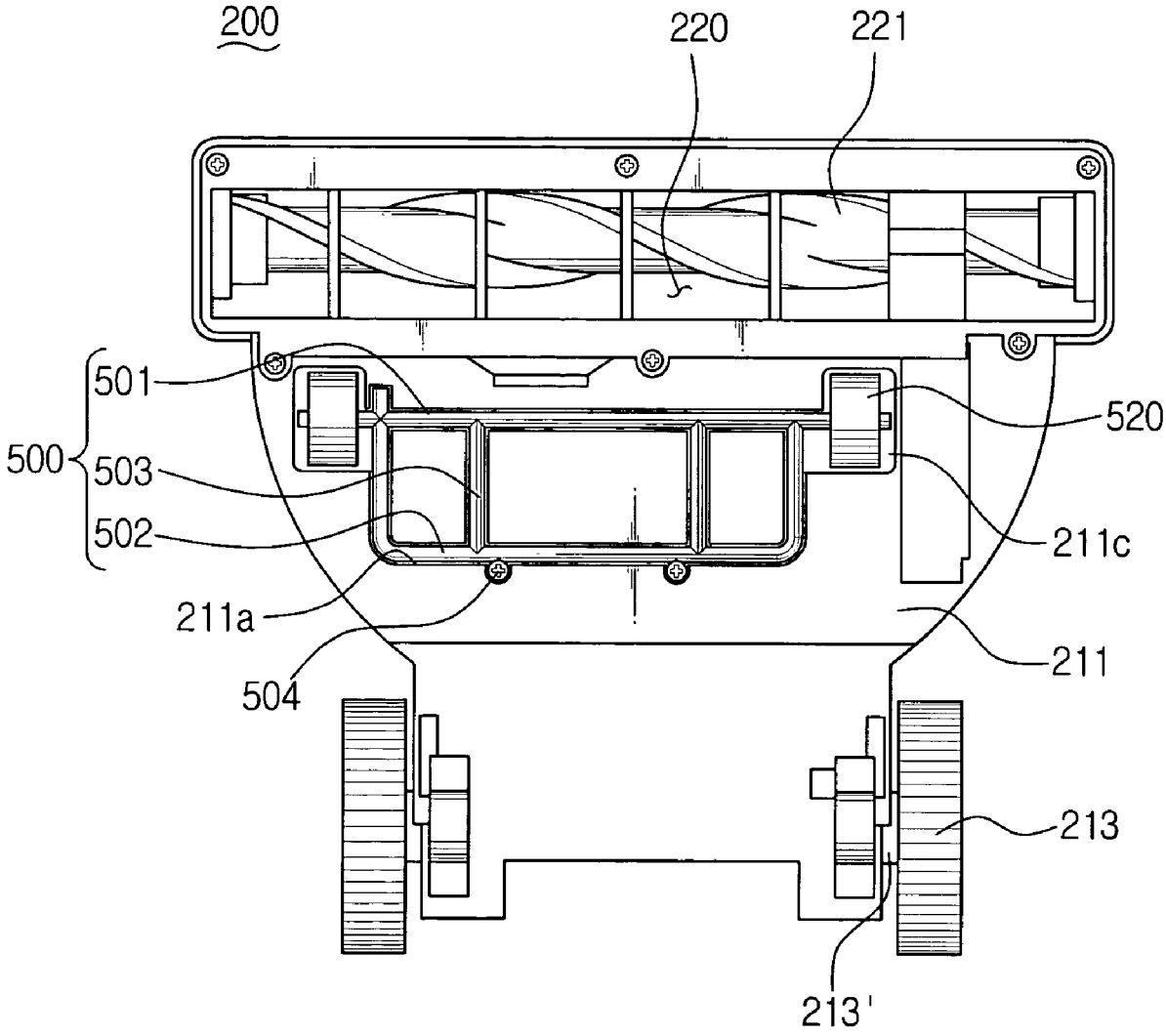
FIG. 3B is a plan view illustrating the lower side of the suction brush of FIG. 2 to show a height adjusting shaft according to a second preferred embodiment of the present invention.
Figure 4B:
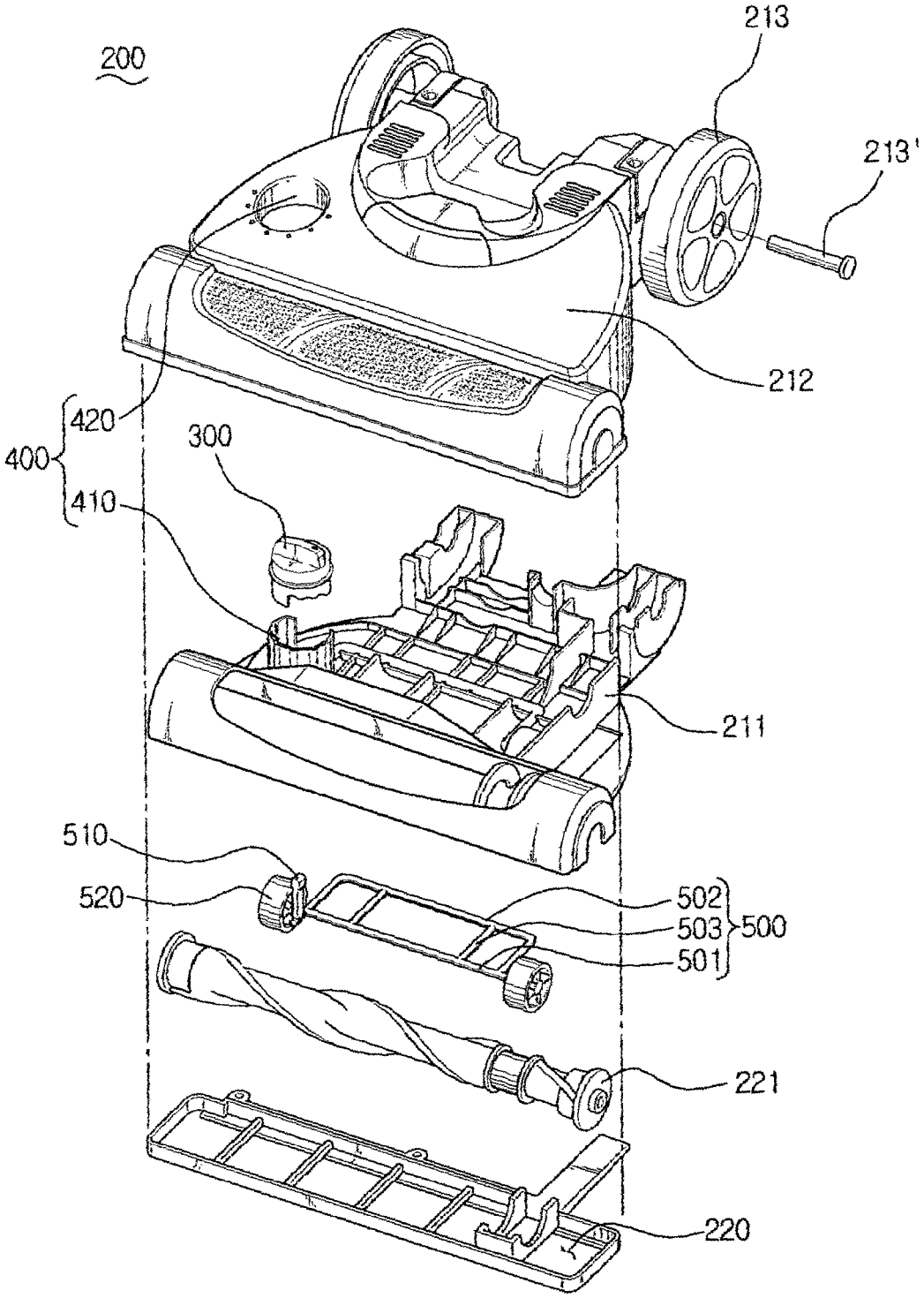
FIG. 4B is an exploded perspective view of a suction brush of a vacuum cleaner having a height adjusting shaft according to a second preferred embodiment of the present invention.

Meanwhile, according to the second preferred embodiment of the present invention, as shown in FIGS. 3B and 4B, the height adjusting shaft 500 may include a shaft body 501 which is connected with both ends to the brush front wheel 520, a rotary shaft 502 connected with both ends to the shaft body 501 and secured into the shaft receiving groove 211*a* to rotate the height adjusting shaft 500, and a reinforcing rib 503 disposed between the shaft body 501 and the rotary shaft 502 to prevent the shaft body 501 from twisting.

The shaft receiving groove 211*a* is communicated with the front wheel receiving hole 211*c* formed through the brush frame 211 such that the front wheel 520 does not interfere with the brush frame 211. Further, the height adjusting shaft 500 is prevented from separating because it is secured to the shaft receiving groove 211*a* by a plurality of screws 504.

Meanwhile, unlike the conventional height adjusting shaft which is made of plastic or steel, the height adjusting shaft 500 according to the present invention is made of aluminum. While the height adjusting shaft made of plastic is light weighted, such plastic height adjusting shaft is apt to break by the load of the cleaner, and while the height adjusting shaft made of steel is robust, it is accompanied with heavy weight. The present invention resolves the above problems by forming the height adjusting shaft 500 with aluminum.

Hereinafter, an operation of the height adjusting apparatus for the upright vacuum cleaner of the present invention will be described in detail with reference to the drawings.

As shown in FIG. 2, in order to adjust the height of the suction brush body 210, the height adjusting knob 300 is disposed in the seating hole 420 formed at the brush cover 212, so that the user can facilely grasp the handle portion 310. Meanwhile, the indicating scales S are provided around the seating hole 420 to represent the height between the suction brush body 210 and the cleaning surface. The indicating scales S may be expressed in figures or geometrical diagrams.

Accordingly, assuming that an initial state is '0', when the user intends to pull apart the suction brush body 210 and the cleaning surface at the desired distance, the user rotates the mark M to indicate a desired one out of the designating scales S. At this time, since each designating scale S is corresponded to each of the recessed grooves 311*a* of the cam curve portion 311 of the height adjusting knob 300, if the user rotates the height adjusting knob 300, the rod member 510 integrally formed with the height adjusting shaft 500 contacted with the cam curve portion 311 is lifted up and down according to the cam curve portion 311.

Figure 8:
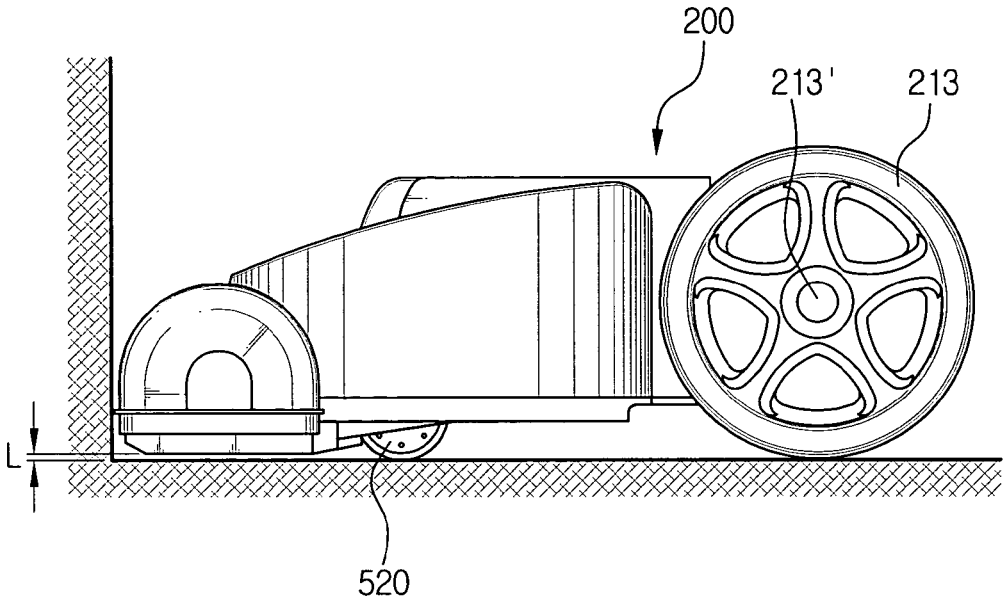
FIG. 8 is a side view showing a status that the suction brush is lifted down to a lowest point by the height adjusting apparatus.
Figure 9:
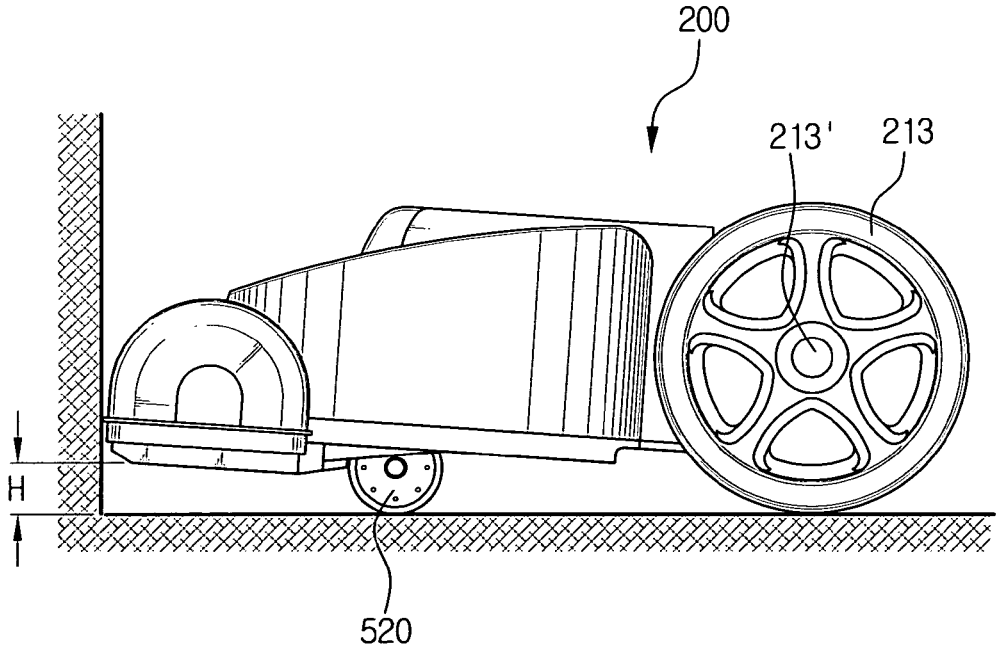
FIG. 9 is a side view showing a status that the suction brush is lifted up to a highest point by the height adjusting apparatus.

That is, the rod member 510 adjusts the position of the brush front wheel 520, while lifting up and down along the cam curve portion 311 of the height adjusting knob 300. As shown in FIG. 8, assuming that the indicating scale S of the first position in which the distance between the suction brush body 210 and the cleaning surface is the shortest is '0', if the user maximally rotates the height adjusting knob 300 so that the mark M indicates the designating scale S of '6', as shown in FIG. 9, the suction brush body 210 is lifted up to the second position in which the distance between the suction brush body 210 and the cleaning surface is the longest.

The height adjusting knob 300 can be rotated and fixed to the desired designating scale S due to the recessed groove 311*a* of the cam curve portion 311. In other words, the cam curve portion 311 has the desired height difference between the starting point and the ending point, and as shown in FIG. 7, each designating scale is corresponded to each of the recessed grooves 311*a* in which the rod member 510 is received in the recessed groove 311*a*. Therefore, although an external impact is applied to the suction brush body 210, the rod member 510 is not separated from its own position. Furthermore, the one or more fixing protrusion 340 provided on the outer circumferential surface of the height adjusting knob 300 is received in the fixing groove 411 formed at the inner surface 410' of the seating member 410. The height adjusting knob 300 is doubly fixed at a setting position. Therefore, it is prevented that the height adjusting knob 300 is optionally rotated and thus the distance between the suction brush body 210 and the cleaning surface is changed.

According to the height adjusting apparatus for a suction brush of an upright vacuum cleaner of the present invention, as described above, a user can adjust a height of the suction brush by simply rotating a height adjusting knob with small force. And since the height adjusting knob is not optionally rotated by an external impact, a distance between a suction brush and a cleaning surface, which is set by the user, is not optionally changed.

In addition, since a rotation of the height adjusting knob is divided into various steps according to a status of the cleaning surface, the user can conveniently perform a cleaning operation on various cleaning surfaces.

While the present invention has been described in detail, it should be understood that various changes, substitutions and alterations can be made hereto without departing from the spirit and scope of the invention as defined by the appended claims.

What is claimed is:

1. A height adjusting apparatus for a suction brush of an upright vacuum cleaner, comprising:

a suction brush body comprised of a brush frame, which has a suction portion for sucking dust at a lower surface thereof and in which a height adjusting shaft can be disposed, the suction brush body having a brush cover for sealing an upper surface of the brush frame except for the suction port;

a height adjusting knob comprised of:

a cylindrical knob body;

a handle portion formed at an upper surface of the knob body, for rotating the height adjusting knob;

a flange portion protruding along an outer circumferential surface of the knob body and determining an inserting position of the knob body;

a fixing protrusion that seats into a fixing groove formed at an inner surface of a seating member and for controlling rotation of the handle, the fixing protrusion protruding from a surface of the flange portion; and a cam curve portion at the bottom of the height adjusting knob, the cam curve portion being rounded, the height adjusting knob being rotatably disposed in a seating portion of the suction brush body, the seating portion being comprised of a seating member formed in the brush frame and having a seating hole formed through the brush cover, the seating member being partially cut away to form a space for allowing the seating member to be elastically deformed; wherein multiple fixing grooves are formed in a length direction of the seating member to be apart from each other at regular intervals, and each fixing groove has a shape corresponding to the fixing protrusion;

the height adjusting knob cam curve portion having a height difference between a starting point and an end point thereof and a plurality of recessed grooves formed between the starting point and the end point;

a horizontal height adjusting shaft having a rod member attached to the height adjusting shaft and which extends upwardly and away from the height adjusting shaft, substantially orthogonal to the height adjusting shaft at its attachment point to the height adjusting shaft, to contact the cam curve portion of the height adjusting knob, the rod member causing the height adjusting shaft to be lifted up and down by the rotation of the height adjusting knob; and a brush front wheel rotatably coupled to the height adjusting shaft.

2. The apparatus of claim 1 wherein the number of multiple fixing grooves correspond to the number of recessed grooves of the cam curve portion.

3. The apparatus of claim 1 wherein the height adjusting knob is rotatably coupled to a shaft receiving groove formed a bottom surface of the brush frame.

4. The apparatus of claim 3, wherein the shaft receiving groove communicates with a front wheel receiving hole formed through the brush frame so that the front wheel is not interfered with by the brush frame, and has a plurality of latching protrusions for preventing a separation of the height adjusting shaft.

5. The apparatus of claim 3, wherein the height adjusting shaft comprises: a shaft body connected at both ends with a brush front wheel; a rotary shaft connected at both ends to the shaft body, secured to the shaft receiving groove by a screw to rotate the height adjusting shaft; and a reinforcing rib disposed between the shaft body and the rotary shaft to prevent the shaft body from twisting.

6. The apparatus of claim 5, wherein the shaft receiving groove is communicated with the front wheel receiving hole formed in the brush frame so that the front wheel is not interfered with the brush frame.

7. The apparatus of claim 5, wherein the height adjusting shaft is made of an aluminum.

* * * * *